US010393132B2

(12) United States Patent
Lee et al.

(10) Patent No.: US 10,393,132 B2
(45) Date of Patent: Aug. 27, 2019

(54) COMPRESSOR USABLE WITHIN A GAS TURBINE ENGINE

(71) Applicant: Siemens Aktiengesellschaft, München (DE)

(72) Inventors: Ching-Pang Lee, Cincinnati, OH (US); Kok-Mun Tham, Oviedo, FL (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 0 days.

(21) Appl. No.: 15/326,505

(22) PCT Filed: Aug. 8, 2014

(86) PCT No.: PCT/US2014/050259
§ 371 (c)(1),
(2) Date: Jan. 16, 2017

(87) PCT Pub. No.: WO2016/022138
PCT Pub. Date: Feb. 11, 2016

(65) Prior Publication Data

US 2017/0198710 A1 Jul. 13, 2017

(51) Int. Cl.
*F01D 11/02* (2006.01)
*F04D 29/08* (2006.01)
(Continued)

(52) U.S. Cl.
CPC ..... *F04D 29/083* (2013.01); *F01D 11/001* (2013.01); *F01D 11/006* (2013.01);
(Continued)

(58) Field of Classification Search
CPC ..... F01D 11/001; F01D 11/08; F01D 11/10; F04D 29/08; F04D 29/083; F04D 29/324; F04D 29/542; F04D 29/685
See application file for complete search history.

(56) References Cited

U.S. PATENT DOCUMENTS 4,238,170 A * 12/1980 Robideau ..... F01D 11/08 415/173.5
5,950,308 A 9/1999 Koff et al.
(Continued)

FOREIGN PATENT DOCUMENTS

| | | | |
|---|---|---|---|
| DE | 102008011746 | A1 | 9/2009 |
| EP | 2213880 | A2 | 8/2010 |
| WO | 2014114662 | A2 | 7/2014 |

OTHER PUBLICATIONS

PCT International Search Report and Written Opinion dated Oct. 16, 2014 corresponding to PCT Application PCT/US2014/050259 filed Aug. 8, 2014. (10 pages).

*Primary Examiner* — Carlos A Rivera
*Assistant Examiner* — Sang K Kim

(57) ABSTRACT

A compressor (10) configured for use in a gas turbine engine (12) and having a rotor assembly (14) with a pumping system (16) positioned on a rotor drum (18) to counteract reverse leakage flow at a gap (20) formed between one or more stator vane tips (22) and a radially outer surface (24) of the rotor drum (18). The pumping system (16) may be from pumping components (26) positioned radially inward of one or more stator vane tips (22) to reduce, if not completely eliminate, reverse leakage flow at the stator vane tips (22). In at least one embodiment, the pumping component (26) may be formed from one or more cutouts (28) in the outer surface (24) of the rotor drum (18). In another embodiment, the pumping component (26) may be formed from at least one pumping fin (30) extending from the radially outer surface (24) of the rotor drum (18). In at least one embodiment, rows (32) of pumping components (26) may be aligned with rows (34) of stator vanes (36) within the compressor (10).

10 Claims, 5 Drawing Sheets

(51) Int. Cl.

| | |
|---|---|
| ***F01D 11/00*** | (2006.01) |
| ***F04D 29/32*** | (2006.01) |
| ***F04D 29/54*** | (2006.01) |

(52) U.S. Cl.

CPC ..... *F01D 11/02* (2013.01); *F04D 29/324* (2013.01); *F04D 29/542* (2013.01)

(56) References Cited

U.S. PATENT DOCUMENTS

| | | | | |
|---|---|---|---|---|
| 7,726,937 | B2 | 6/2010 | Baumann et al. | |
| 8,038,388 | B2 | 10/2011 | Freling et al. | |
| 8,251,648 | B2 * | 8/2012 | Johann | F04D 29/685 415/173.1 |
| 8,257,022 | B2 * | 9/2012 | Guemmer | F04D 29/685 415/144 |
| 8,317,457 | B2 | 11/2012 | Wadia et al. | |
| 2005/0152778 | A1 | 7/2005 | Lewis | |
| 2008/0056895 | A1 | 3/2008 | Senoo | |
| 2009/0041576 | A1 * | 2/2009 | Guemmer | F04D 29/526 415/149.4 |
| 2014/0205441 | A1 | 7/2014 | Lee | |
| 2014/0356143 | A1 * | 12/2014 | Guemmer | F04D 29/161 415/173.5 |

* cited by examiner

COMPRESSOR USABLE WITHIN A GAS TURBINE ENGINE

FIELD OF THE INVENTION

This invention is directed generally to compressors within gas turbine engines, and more particularly, to stator and rotor assemblies within compressors.

BACKGROUND

Turbine engines typically include a plurality of rows of stationary compressor stator vanes extending radially inward from a shell and include plurality of rows of rotatable compressor blades attached to a rotor assembly for turning the rotor. Conventional turbine engines often include a segment with multiple stationary airfoils collectively referred to as a stator. The stator vanes extend radially inward and terminate at a stator vane tip in close proximity to a radially outer surface of the rotor assembly. While that stator vane tip terminates in close proximity to the radially outer surface of the rotor assembly, a gap exists between the stator vane tip and the rotor. During operation, a reverse leakage flow can develop whereby air travels upstream in the gap between the stator vane tip and the rotor, as shown in FIG. 1, due to the increased pressure downstream. Such reverse leakage flow reduces the efficiency of the compressor and therefore, the turbine engine in which the compressor is positioned.

SUMMARY OF THE INVENTION

A compressor configured for use in a gas turbine engine and having a rotor assembly with a pumping system positioned on a rotor drum to counteract reverse leakage flow at a gap formed between one or more stator vane tips and a radially outer surface of the rotor drum. The pumping system may be from pumping components positioned radially inward of one or more stator vane tips to reduce, if not completely eliminate, reverse leakage flow at the stator vane tips. In at least one embodiment, the pumping component may be formed from one or more cutouts in the radially outer surface of the rotor drum. In another embodiment, the pumping component may be formed from at least one pumping fin extending from the radially outer surface of the rotor drum. In at least one embodiment, rows of pumping components may be aligned with rows of stator vanes within the compressor.

In at least one embodiment, the compressor for a gas turbine engine may include a stator assembly formed from a plurality of stator vanes, whereby one or more stator vanes is formed from a generally elongated airfoil having a leading edge, a trailing edge, a pressure side, a suction side, an endwall coupled to a first end and a tip extending radially inwardly and terminating proximate to a rotor assembly. The rotor assembly may be formed from a rotor drum having a radially outer surface and a plurality of compressor blades, whereby one or more compressor blades is formed from a generally elongated airfoil having a leading edge, a trailing edge, a pressure side, a suction side, a platform at a first end and a tip extending radially outwardly and terminating proximate to the stator assembly. The compressor may include a pumping system positioned on the rotor drum and aligned radially with one or more stator vanes, whereby the pumping system may include one or more pumping components configured to pump air in an axially downstream direction to counteract reverse leakage flow at a gap formed between the stator vane tip and the radially outer surface of the rotor drum.

In at least one embodiment, the pumping component may be formed from one or more cutouts in the radially outer surface of the rotor drum. The cutout may have a tapered depth. The cutout has a tapered depth with a deeper side of the cutout positioned on an upper rotation side than a shallow side relative to a direction of rotation of the rotor drum. The tapered depth of the cutout may be linear. The cutout may extend nonlinearly within the radially outer surface of the rotor drum. The cutout may include a plurality of cutouts aligned into a row on the radially outer surface of the rotor drum and aligned relative to the stator vane. The plurality of cutouts may form a plurality of rows extending circumferentially around the rotor drum, whereby the rows of cutouts may be spaced axially and aligned with rows of stator vanes. The cutout may be positioned such that at least a portion of the cutout may overlap an axially extending axis from an end of an adjacent cutout. The cutout may be positioned nonparallel and nonorthogonal relative to the stator vane. The cutout may be positioned nonparallel and nonorthogonal relative to a longitudinal axis of the rotor drum.

In another embodiment, the pumping component may be formed from one or more pumping fins extending from the radially outer surface of the rotor drum. The pumping fin may extend nonlinearly along the radially outer surface of the rotor drum. The pumping fin may form a concave surface on a surface of the pumping fin facing away from a direction of rotation of the rotor drum. The pumping fin may also form a convex surface on a surface of the pumping fin facing toward the direction of rotation of the rotor drum. In at least one embodiment, the pumping fin may be formed from a plurality of pumping fins aligned into a row on the radially outer surface of the rotor drum and aligned relative to the stator vane. The plurality of pumping fins may form a plurality of rows extending circumferentially around the rotor drum, whereby the rows of pumping fins may be spaced axially and aligned with rows of stator vanes. The pumping fin may be positioned nonparallel and nonorthogonal relative to the stator vane. The pumping fin may be positioned nonparallel and nonorthogonal relative to a longitudinal axis of the rotor drum.

In at least one embodiment, an upstream end of the pumping fin may terminate before being aligned with an adjacent, upstream compressor blade forming a compressor blade stage upstream from the stator vane. A downstream end of the pumping fin may terminate before being aligned with an adjacent, downstream compressor blade forming a compressor blade stage downstream from the stator vane. The pumping fin may have a generally curved longitudinal axis. The pumping fin may have a generally rectangular cross-section.

During use, the rotor assembly rotates in the direction of rotation. As such, the pumping components of the pumping system rotate past the stator vane tips in the gap. The configuration of the pumping components creates a pumping action of air in a downstream direction through the gap. As such, the pumping system counteracts any reverse leakage flow at a gap formed between one or more stator vane tips and a radially outer surface of the rotor drum and substantially prevents formation of any reverse leakage flow.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
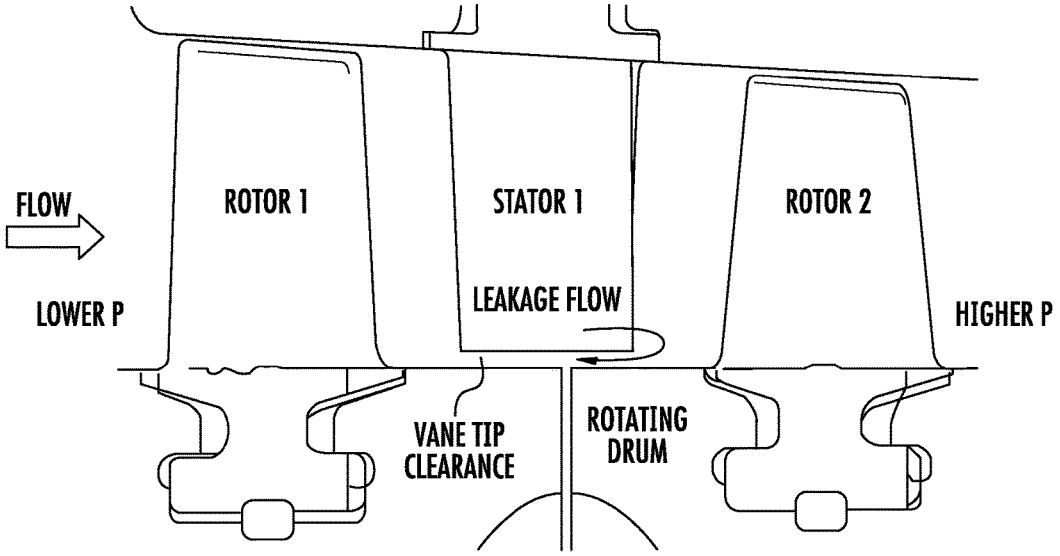
FIG. 1 (PRIOR ART)
FIG. 1 is a perspective view of a conventional stator vane positioned relative to a rotor drum and forming a gap therebetween.
Figure 2:
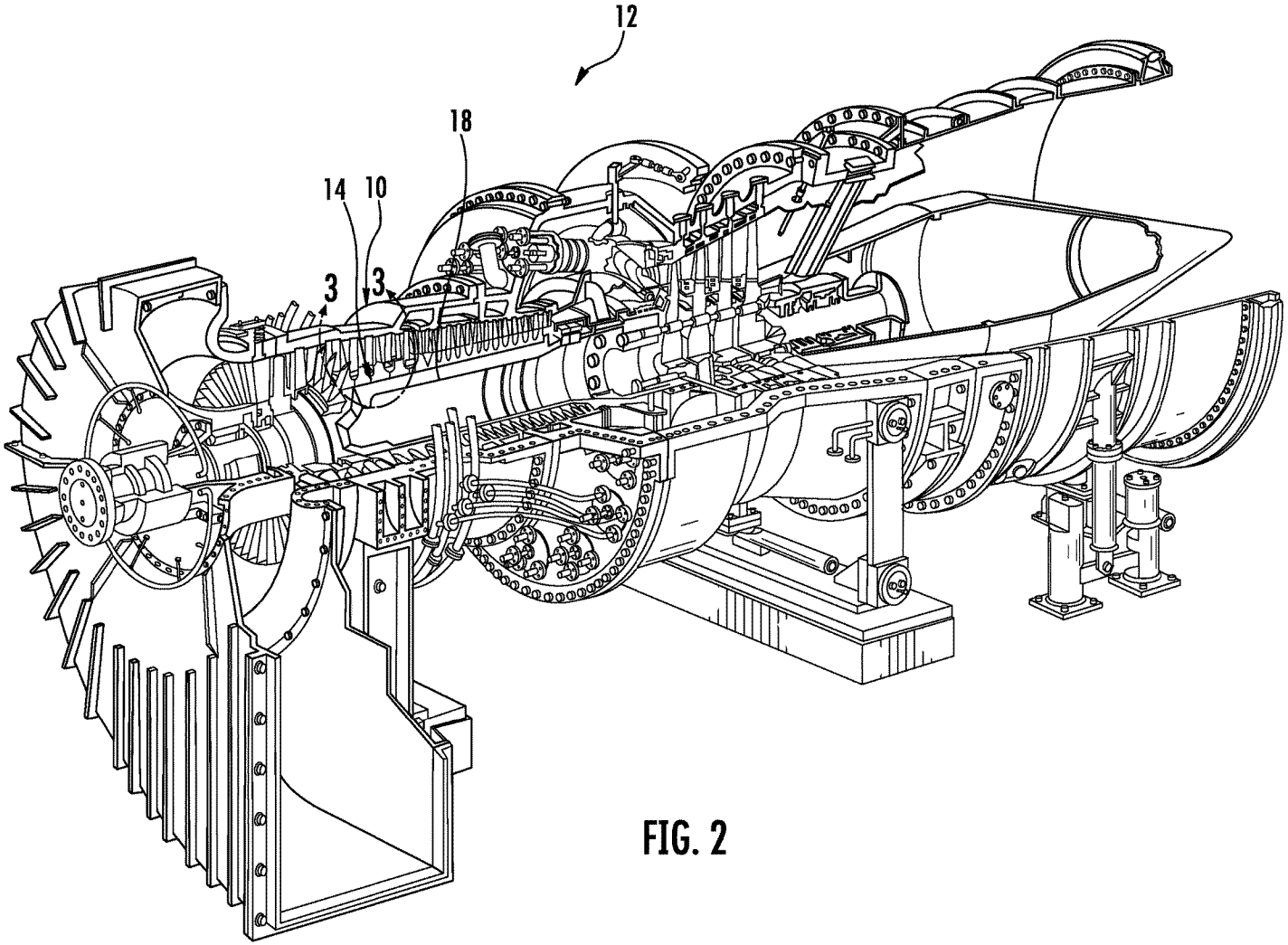
FIG. 2 is a partial cross-sectional, perspective view of a gas turbine engine.
Figure 3:
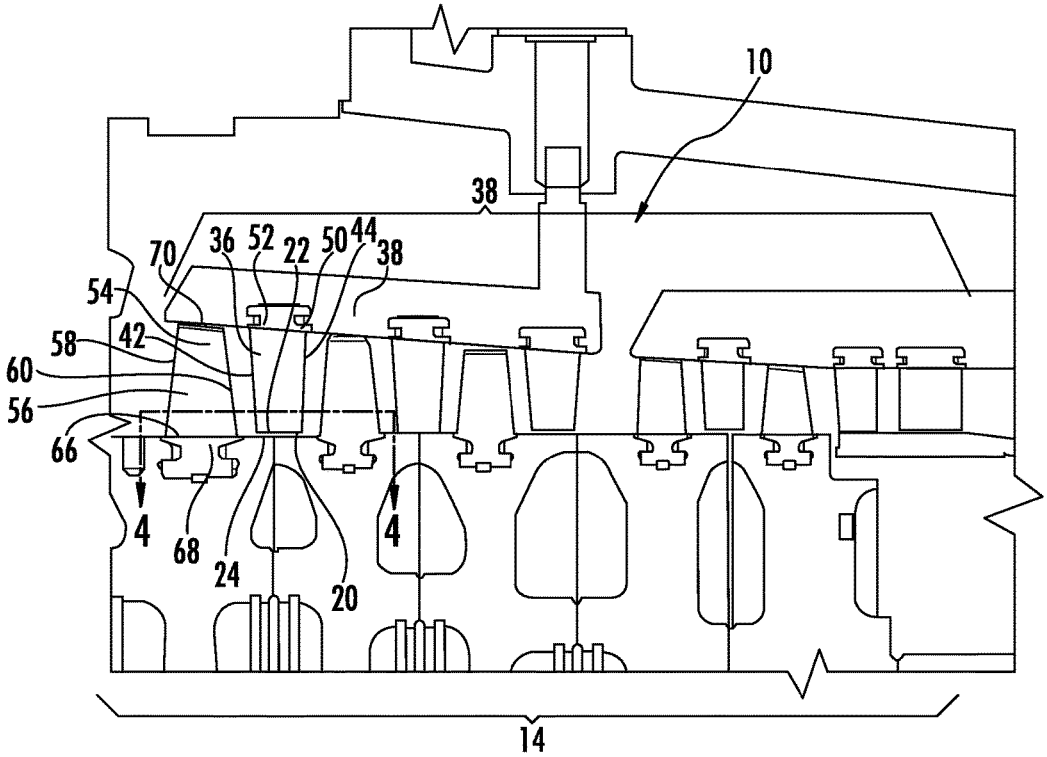
FIG. 3 is a detail cross-sectional, side view of a compressor of the gas turbine engine of FIG. 2 taken at detail line 3-3.

As shown in FIGS. 2-7, a compressor 10 configured for use in a gas turbine engine 12 and having a rotor assembly 14 with a pumping system 16 positioned on a rotor drum 18 to counteract reverse leakage flow at a gap 20 formed between one or more stator vane tips 22 and a radially outer surface 24 of the rotor drum 18. The pumping system 16 may be from pumping components 26 positioned radially inward of one or more stator vane tips 22 to reduce, if not completely eliminate, reverse leakage flow at the stator vane tips 22. In at least one embodiment, the pumping component 26 may be formed from one or more cutouts 28 in the radially outer surface 24 of the rotor drum 18. In another embodiment, the pumping component 26 may be formed from one or more pumping fins 30 extending from the radially outer surface 24 of the rotor drum 18. In at least one embodiment, rows 32 of pumping components 26 may be aligned with rows 34 of stator vanes 36 within the compressor 10.

In at least one embodiment, a compressor 10 for a gas turbine engine 12 may include a stator assembly 38 formed from a plurality of stator vanes 38. One or more stator vanes 38 may be formed from a generally elongated airfoil 40 having a leading edge 42, a trailing edge 44, a pressure side 46, a suction side 48, an endwall 50 coupled to a first end 52 and a tip 22 extending radially inwardly and terminating proximate to a rotor assembly 14. The rotor assembly 14 may be formed from a rotor drum 18 having a radially outer surface 24 and a plurality of compressor blades 54, whereby one or more compressor blades 54 may be formed from a generally elongated airfoil 56 having a leading edge 58, a trailing edge 60, a pressure side 62, a suction side 64, a platform 66 at a first end 68 and a tip 70 extending radially outwardly and terminating proximate to the stator assembly 38.

Figure 4:
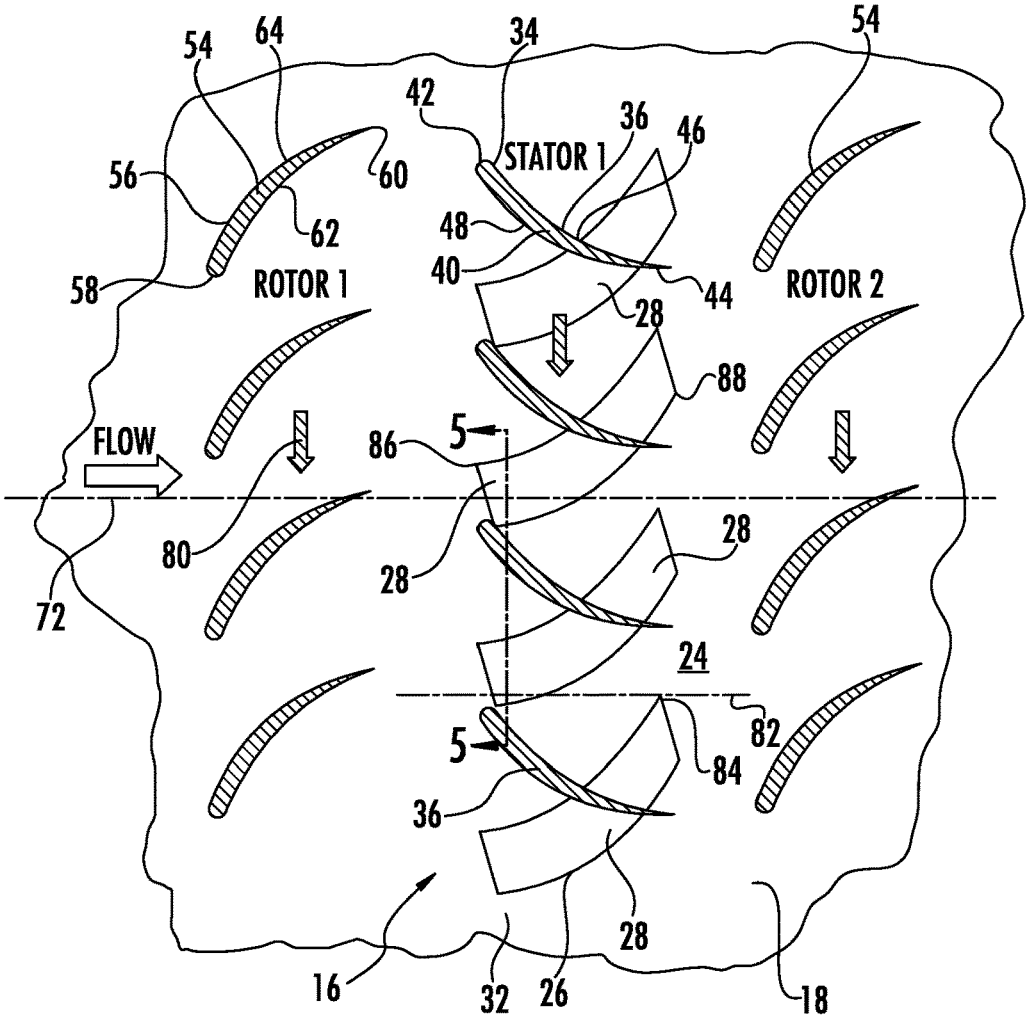
FIG. 4 is a cross-sectional view of stator vanes and rotor blades within a compressor and a pumping system taken at section line 4-4 in FIG. 3.
Figure 5:
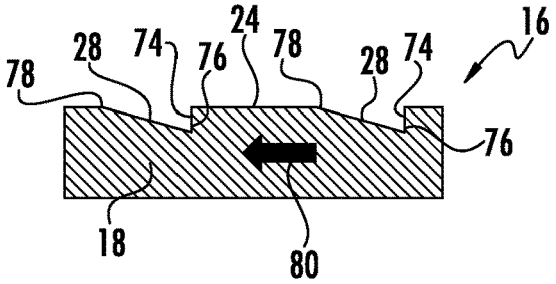
FIG. 5 is a cross-sectional view of cutouts taken at section line 5-5 in FIG. 4.

One or more pumping systems 16 may be positioned on the rotor drum 18 and may be aligned radially with one or more stator vanes 36. The pumping system 16 may include one or more pumping components 26 configured to pump air in an axially downstream direction to counteract reverse leakage flow at the gap 20 formed between the stator vane tip 22 and the radially outer surface 24 of the rotor drum 18. In at least one embodiment, as shown in FIGS. 4 and 5, the pumping component 26 may be formed from one or more cutouts 28 in the radially outer surface of the rotor drum 18. The cutout 28 may be configured to direct air downstream. In at least one embodiment, the cutout 28 may have a generally curved rectangular shape, such as a four sided shape. The cutout 28 may be positioned nonparallel and nonorthogonal relative to the stator vane 36. The cutout 28 may be positioned nonparallel and nonorthogonal relative to a longitudinal axis 72 of the rotor drum 18. In at least one embodiment, at least a portion of the cutout 28 may overlap an axially extending axis 82 from an end 84 of an adjacent cutout 28.

In at least one embodiment, the cutout 28 may have a tapered depth. The cutout 28 may have a tapered depth with a deeper side 74 of the cutout 28 positioned on an upper rotation side 76 than a shallow side 78 relative to a direction of rotation 80 of the rotor drum 18. The tapered depth of the cutout 28 may be linear or nonlinear. In at least one embodiment, the cutout 28 may have a depth between about 0.5 percent and about three percent of a radial length of a vane 36. The cutout 28 may extend nonlinearly within the radially outer surface 24 of the rotor drum 18.

In at least one embodiment, the pumping system 16 may include a plurality of cutouts 28 aligned into a row 32 on the radially outer surface 24 of the rotor drum 18 and aligned relative to the stator vane 36. The plurality of cutouts 28 may form a plurality of rows 32 extending circumferentially around the rotor drum 18. The rows 32 of cutouts 28 may be spaced axially and aligned with rows 34 of stator vanes 36. In at least one embodiment, an upstream end 86 of the at least one cutout 28 may terminate before being aligned with an adjacent, upstream compressor blade 54 forming a compressor blade stage upstream from the stator vane 36. The cutout 28 may be positioned such that the upstream 86 end of the cutout 28 may terminate in axially lateral alignment with the leading edge 42 of the stator vane 36. The cutout 28 may be positioned such that a downstream end 88 of the cutout 28 may terminate before being aligned with an adjacent, downstream compressor blade 54 forming a compressor blade stage downstream from the stator vane 36. The cutout 28 may be positioned such that the downstream end 88 of the cutout 28 may terminate in axially lateral alignment with the trailing edge 44 of the stator vane 36.

Figure 6:
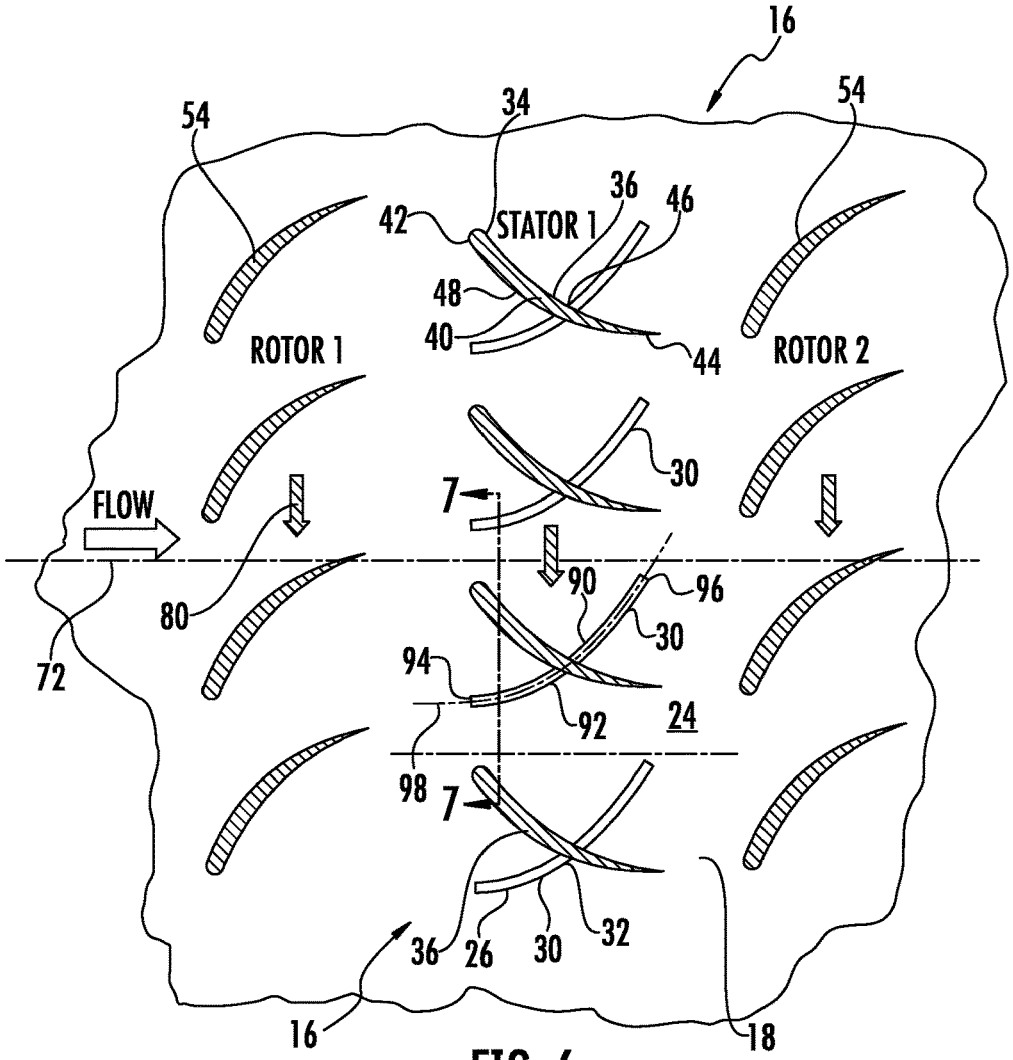
FIG. 6 is a cross-sectional view of stator vanes and rotor blades within a compressor and an alternative embodiment of the pumping system taken at section line 4-4 in FIG. 3.
Figure 7:
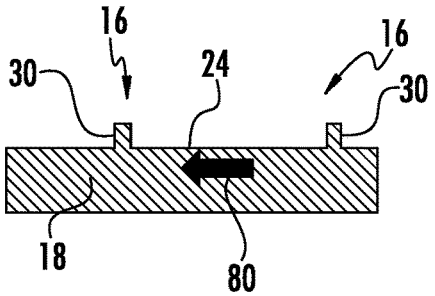
FIG. 7 is a cross-sectional view of cutouts taken at section line 7-7 in FIG. 6.

In another embodiment, as shown in FIGS. 6 and 7, the pumping component 26 may be formed from one or more pumping fins 30 extending from the radially outer surface 24 of the rotor drum 18. The pumping fin 30 may extend nonlinearly along the radially outer surface 24 of the rotor drum 18. The pumping fin 30 may form a concave surface 90 on a surface of the pumping fin 30 facing away from the direction of rotation 80 of the rotor drum 18. The pumping fin 30 may form a convex surface 92 on a surface of the pumping fin 30 facing toward a direction of rotation 80 of the rotor drum 18. The pumping fin 30 may be positioned nonparallel and nonorthogonal relative to the stator vane 36. The pumping fin 30 may be positioned nonparallel and nonorthogonal relative to the longitudinal axis 72 of the rotor drum 18. The pumping fin 30 may have a generally curved longitudinal axis 98. The pumping fin 30 may have a generally rectangular cross-section or other appropriate shape. In at least one embodiment, a height of the pumping fin 30 extending radially outward may be between about one and four times a width of the pumping fin 30.

In at least one embodiment, the pumping system 16 may include a plurality of pumping fins 30 aligned into a row 32 on the radially outer surface 24 of the rotor drum 18 and aligned relative to the stator vane 36. The plurality of pumping fins 30 may form a plurality of rows 32 extending circumferentially around the rotor drum 18. The rows 32 of pumping fins 30 may be spaced axially and aligned with rows 34 of stator vanes 36. The pumping fin 30 may be positioned such that an upstream end 94 of the pumping fin 30 may terminate before being aligned with an adjacent, upstream compressor blade 54 forming a compressor blade stage upstream from the stator vane 36. The pumping fin 30 may be positioned such that the upstream end 94 of the pumping fin 30 may terminate in axially lateral alignment with the leading edge 42 of the stator vane 36. The pumping fin 30 may be positioned such a downstream end 96 of the pumping fin 30 terminates before being aligned with an adjacent, downstream compressor blade 54 forming a compressor blade stage downstream from the stator vane 36. A downstream end 96 of the pumping fin 30 may terminate in axially lateral alignment with the trailing edge 44 of the stator vane 36.

During use, the rotor assembly rotates in the direction of rotation 80. As such, the pumping components 26 of the pumping system 16 rotate past the stator vane tips 22 in the gap 20. The configuration of the pumping components 26 creates a pumping action of air in a downstream direction through the gap 20. As such, the pumping system 16 counteracts any reverse leakage flow at a gap 20 formed between one or more stator vane tips 22 and a radially outer surface 24 of the rotor drum 18 and substantially prevents formation of any reverse leakage flow. The deliberate pumping action from the pumping components 26, including, but not limited to, the cutout 28 and the pumping fin 36, also serves to reduce the sensitivity of the leakage flow to actual operating vane tip clearance.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A compressor for a gas turbine engine, comprising:

a stator assembly formed from a plurality of stator vanes, wherein at least one stator vane is formed from a generally elongated airfoil having a leading edge, a trailing edge, a pressure side, a suction side, an endwall coupled to a first end and a tip extending radially inwardly and terminating proximate to a rotor assembly;

wherein the rotor assembly is formed from a rotor drum having a radially outer surface and a plurality of compressor blades wherein at least one compressor blade is formed from a generally elongated airfoil having a leading edge, a trailing edge, a pressure side, a suction side, a platform at a first end and a tip extending radially outwardly and terminating proximate to the stator assembly;

a pumping system positioned on the rotor outer surface of the rotor drum and aligned radially with at least one stator vane, wherein the pumping system includes at least one pumping component configured to pump air in an axially downstream direction to counteract reverse leakage flow at a gap formed between the stator vane tip and the radially outer surface of the rotor drum, wherein the at least one pumping component comprises at least one cutout, wherein the cutout is positioned so that a downstream end of the cutout terminates in axially lateral alignment with the trailing edge of the stator vane and an upstream end of the cutout terminates in axially lateral alignment with the leading edge of the stator vane, wherein at least a portion of the at least one cutout overlaps an axially extending axis from an end of an adjacent cutout, and wherein the at least one cutout comprises a plurality of circumferentially spaced cutouts aligned into a row on the radially outer surface of the rotor drum and aligned relative to the at least one stator vane.

2. The compressor of claim 1, wherein the at least one cutout is formed in the radially outer surface of the rotor drum.

3. The compressor of claim 2, characterized in that wherein the at least one cutout has a tapered depth.

4. The compressor of claim 3, characterized in that wherein the at least one cutout has a tapered depth with a deeper side than a shallow side.

5. The compressor of claim 3, wherein the tapered depth of the at least one cutout is linear.

6. The compressor of claim 1, wherein the at least one cutout extends nonlinearly within the radially outer surface of the rotor drum.

7. The compressor of claim 1, further comprising a plurality of rows of cutouts extending circumferentially around the rotor drum, wherein the plurality of rows of cutouts are spaced axially and aligned with rows of stator vanes.

8. The compressor of claim 1, wherein at least a portion of the at least one cutout overlaps an axially extending axis from an end of an adjacent cutout.

9. The compressor of claim 1, wherein the at least one cutout is positioned nonparallel and nonorthogonal relative to the at least one stator vane.

10. The compressor of claim 1, wherein the at least one cutout is positioned nonparallel and nonorthogonal relative to a longitudinal axis of the rotor drum.

* * * * *